US009683587B2

(12) United States Patent
Ito et al.

(10) Patent No.: US 9,683,587 B2
(45) Date of Patent: Jun. 20, 2017

(54) FLUID PRESSURE CONTROL DEVICE

(71) Applicant: KAYABA INDUSTRY CO., LTD., Minato-ku, Tokyo (JP)

(72) Inventors: Tatsuo Ito, Kanagawa (JP); Mitsuhiro Maesaki, Kanagawa (JP)

(73) Assignee: KYB Corporation, Tokyo (JP)

( * ) Notice: Subject to any disclaimer, the term of this patent is extended or adjusted under 35 U.S.C. 154(b) by 402 days.

(21) Appl. No.: 14/370,958

(22) PCT Filed: Jan. 18, 2013

(86) PCT No.: PCT/JP2013/050981
§ 371 (c)(1),
(2) Date: Jul. 7, 2014

(87) PCT Pub. No.: WO2013/114980
PCT Pub. Date: Aug. 8, 2013

(65) Prior Publication Data

US 2015/0013322 A1 Jan. 15, 2015

(30) Foreign Application Priority Data

Feb. 3, 2012 (JP) ..... 2012-021993

(51) Int. Cl.
*F15B 15/08* (2006.01)
*F15B 15/20* (2006.01)
*F15B 11/00* (2006.01)

(52) U.S. Cl.
CPC ..... *F15B 15/08* (2013.01); *F15B 11/003* (2013.01); *F15B 11/006* (2013.01); *F15B 15/20* (2013.01);
(Continued)

(58) Field of Classification Search
CPC ... F15B 11/003; F15B 11/0423; F15B 11/044; F15B 2211/30515; F15B 2211/30535;
(Continued)

(56) References Cited

U.S. PATENT DOCUMENTS 2,840,104 A * 6/1958 Shafer ..... F16K 17/105 137/489.5
3,952,509 A * 4/1976 Coleman ..... E02F 9/2232 180/403
(Continued)

FOREIGN PATENT DOCUMENTS

JP 5330094 U 3/1978
JP 6386404 U 6/1988
(Continued)

OTHER PUBLICATIONS

International Search Report and Written Opinion dated Apr. 2, 2013, corresponds to PCT/JP2013/050981.

*Primary Examiner* — Eric Keasel
*Assistant Examiner* — Matthew Wiblin
(74) *Attorney, Agent, or Firm* — Hauptman Ham, LLP

(57) ABSTRACT

A fluid pressure control device includes a first control valve that switches to supply a working fluid to the pressure chamber of a cylinder on which a load pressure by the load acts so as to control the extension operation of the cylinder, a second control valve that switches to discharge the working fluid in the pressure chamber so as to control the contraction operation of the cylinder, an operate check valve that is interposed between the pressure chamber and the second control valve and that interrupts the discharge of the working fluid from the pressure chamber when the operate check valve is switched to a closed state and a pilot valve that performs, with a pilot pressure, a pilot operation on the second control valve and that switches, with the pilot pressure, the operate check valve to an opened state.

5 Claims, 2 Drawing Sheets

(52) U.S. Cl.
CPC ..... *F15B 2211/30515* (2013.01); *F15B 2211/30535* (2013.01); *F15B 2211/30575* (2013.01); *F15B 2211/329* (2013.01); *F15B 2211/351* (2013.01); *F15B 2211/353* (2013.01); *F15B 2211/7052* (2013.01)

(58) Field of Classification Search
CPC ..... F15B 2211/30575; F15B 2211/351; F15B 2211/353
See application file for complete search history.

(56) References Cited

U.S. PATENT DOCUMENTS

| | | | | |
|---|---|---|---|---|
| 6,502,393 | B1 * | 1/2003 | Stephenson | F15B 11/006 60/414 |
| 2007/0074510 | A1 * | 4/2007 | VerKuilen | F15B 11/006 60/422 |
| 2011/0023477 | A1 * | 2/2011 | Skoog | F15B 11/003 60/459 |

FOREIGN PATENT DOCUMENTS

| | | | | |
|---|---|---|---|---|
| JP | 6434879 | A | | 2/1989 |
| JP | 544702 | A | | 2/1993 |
| JP | 8182406 | A | | 7/1996 |
| JP | 8261206 | A | | 10/1996 |
| JP | 09208160 | A | * | 8/1997 |
| JP | 9208160 | A | | 8/1997 |
| JP | 10101277 | A | | 4/1998 |
| JP | 2002330936 | A | | 11/2002 |
| JP | 2004229920 | A | | 8/2004 |
| KR | 10-2007-0090361 | A | | 9/2007 |

* cited by examiner

FLUID PRESSURE CONTROL DEVICE

RELATED APPLICATIONS

The present application is a National Phase of International Application Number PCT/JP2013/050981, filed Jan. 18, 2013, which claims priority to Japanese Application Number 2012-021993, filed Feb. 3, 2012.

TECHNICAL FIELD

The present invention relates to a fluid pressure control device that controls a fluid pressure operation machine such as a tractor.

BACKGROUND ART

Conventionally, in a fluid pressure operation machine such as a tractor, a fluid pressure control device is used that uses a working fluid discharged from a fluid pressure pump to drive an actuator.

JP08-261206A discloses a hydraulic control device that controls the ascent and descent of the lift cylinder of a farm tractor. This hydraulic control device includes an ascent valve that is provided between a hydraulic pump and the lift cylinder and that is controlled by an adjustment value, a descent proportional solenoid valve that is provided between the lift cylinder and a tank, and a check valve which is provided between the lift cylinder and the descent proportional solenoid valve and in which the opening and closing thereof is controlled by a pilot valve.

SUMMARY OF INVENTION

In the hydraulic control device disclosed in JP08-261206A, three solenoid valves, that is, the adjustment valve, the descent proportional solenoid valve and the pilot valve are provided. Since as described above, in addition to a pair of solenoid valves used for expanding and contracting the lift cylinder, a solenoid valve for switching the check valve is provided, the configuration of the hydraulic control device is complicated.

In view of the foregoing problem, the present invention is made, and an object of the present invention is to simplify the configuration of a fluid pressure control device that controls a fluid pressure operation machine.

According to one aspect of this invention, a fluid pressure control device which makes a cylinder expand and contract with a working fluid supplied from a pump to be able to drive a load and in which the cylinder includes a pressure chamber on which a load pressure by the load acts in a state where supply and discharge of the working fluid are interrupted. The fluid pressure control device includes: a first control valve that is configured to switch to supply the working fluid to the pressure chamber so as to control an extension operation of the cylinder; a second control valve that is configured to switch to discharge the working fluid in the pressure chamber so as to control a contraction operation of the cylinder; an operate check valve that is interposed between the pressure chamber and the second control valve and that interrupts the discharge of the working fluid from the pressure chamber when the operate check valve is switched to a closed state; and a pilot valve that is configured to perform, with a pilot pressure, a pilot operation on the second control valve and that is configured to switch, with the pilot pressure, the operate check valve to an opened state.

The details as well as other features and advantages of this invention are set forth in the remainder of the specification and are shown in the accompanying drawings.

DESCRIPTION OF EMBODIMENTS

A hydraulic control device 100 will be described below as a fluid pressure control device according to an embodiment of the present invention with reference to drawings.

The hydraulic control device 100 controls the operation of a fluid pressure operation machine such as a tractor. In the hydraulic control device 100, a working oil is used as a working fluid.

Figure 1:
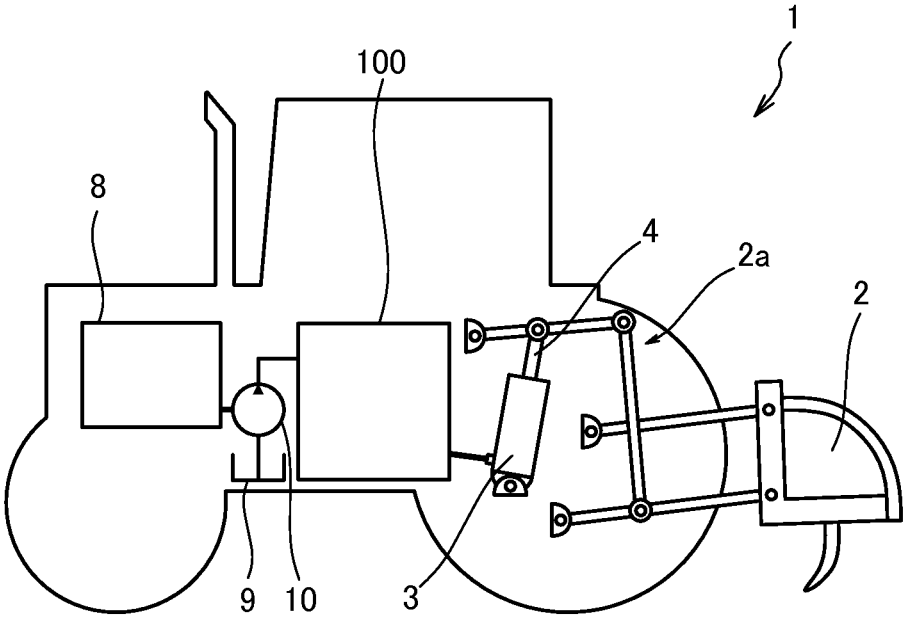
FIG. 1 is a configuration diagram of a tractor to which a fluid pressure control device according to an embodiment of the present invention is applied.
Figure 2:
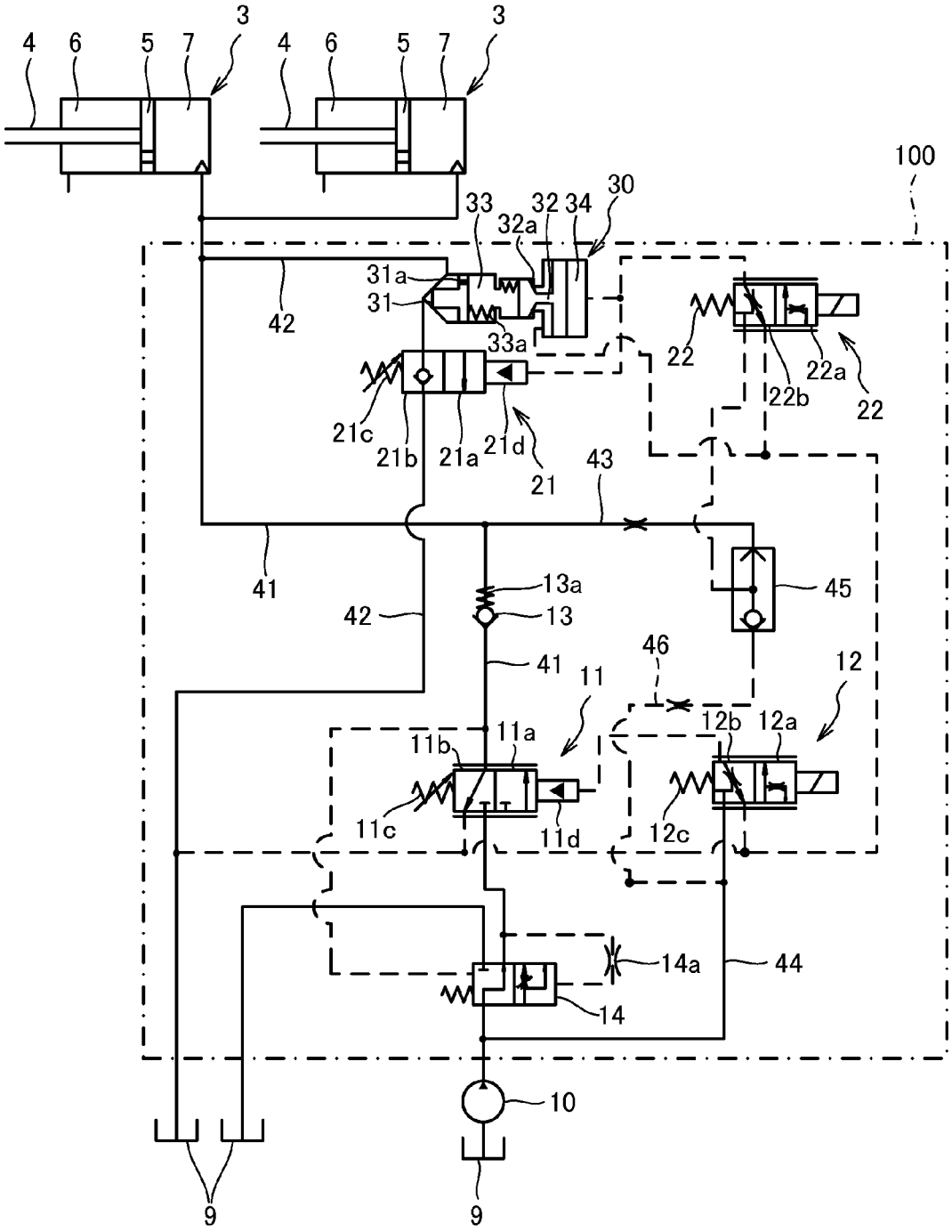
FIG. 2 is a fluid pressure circuit diagram of the fluid pressure control device according to the embodiment of the present invention.

With reference to FIGS. 1 and 2, the overall configuration of a tractor 1 to which the hydraulic control device 100 is applied will first be described.

As shown in FIG. 1, the tractor 1 includes a tank 9 in which the working oil is stored, a pump 10 that discharges the working oil sucked from the tank 9, a cylinder 3 that performs an expansion and extraction operation by the working oil from the pump 10, an operation machine 2 that serves as a load which moves up and down as the cylinder 3 expands and contracts and the hydraulic control device 100 that controls the expansion and extraction operation of the cylinder 3.

The operation machine 2 is provided such that it can be attached to and removed from the back portion of the tractor 1. The operation machine 2 moves up and down by transmission of the expansion and extraction operation of the cylinder 3 through a link mechanism 2*a*. Instead of a rotary to which a plurality of hooks for tillage as shown in FIG. 1 are attached, a leveler that levels the ground or the like may be attached as the operation machine 2.

The pump 10 is a gear pump that is driven to rotate by an engine 8. The engine 8 that drives the pump 10 also operates to drive the wheels of the tractor 1. The pump 10 is commonly driven to rotate when the engine 8 is in an operated state.

The cylinder 3 is a ram cylinder that is fixed to the main body of the tractor 1. The cylinder 3 includes a piston rod 4 that is coupled to the operation machine 2 through the link mechanism 2*a* and that moves the operation machine 2 up and down.

As shown in FIG. 2, within the cylinder 3, a rod side pressure chamber 6 into which the piston rod 4 is inserted by a piston 5 coupled to the piston rod 4 and a piston side pressure chamber 7 that is opposite the rod side pressure chamber 6 through the piston 5 are defined. Since the cylinder 3 is a ram cylinder, in a state where the supply and the discharge of the working oil are interrupted, a load pressure by the operation machine 2 is exerted both on the rod side pressure chamber 6 and on the piston side pressure chamber 7. Hence, in the cylinder 3, both the rod side pressure chamber 6 and the piston side pressure chamber 7 apply to the pressure chamber. Although in the present embodiment, a pair of cylinders 3 are provided, when the load is relatively small, a single cylinder may be provided.

The hydraulic circuit of the hydraulic control device 100 will now be described with reference to FIG. 2.

The hydraulic control device 100 performs, with the working oil supplied from the pump 10, expansion and contraction control on the cylinder 3, and thereby drives and moves up and down the operation machine 2.

The hydraulic control device 100 includes a supply passage 41 that guides, when the cylinder 3 is extended, the working oil discharged from the pump 10 to the piston side pressure chamber 7 and a discharge passage 42 that guides, when the cylinder 3 is made to contract, the working oil discharged from the piston side pressure chamber 7 to the tank 9.

The hydraulic control device 100 includes a first control valve 11 that controls the extension operation of the cylinder 3 by switching to supply the working oil to the piston side pressure chamber 7, a first pilot valve 12 that performs a pilot operation on the first control valve 11 with a pilot pressure, a check valve 13 that allows only the passage of the working oil supplied from the pump 10 to the piston side pressure chamber 7 and an unload valve 14 that guides the working oil discharged from the pump 10 to the tank 9 when a pressure difference before and after the first control valve 11 is raised to a set pressure. The first control valve 11, the check valve 13, and the unload valve 14 are interposed in the supply passage 41.

The first control valve 11 has a supply position 11*a* in which the working oil from the pump 10 can be passed and an interruption position 11*b* in which the working oil from the pump 10 is interrupted to guide the downstream working oil to the tank 9. The first control valve 11 includes an adjustment spring 11*c* that can adjust an acting force and a pilot portion 11*d* to which the pilot pressure from the first pilot valve 12 is guided.

The first control valve 11 is switched by the acting force of the adjustment spring 11*c* to the interruption position 11*b* in a state where the pilot pressure is not guided from the first pilot valve 12 (the state shown in the figure).

When the pilot pressure from the first pilot valve 12 is guided to the pilot portion 11*d*, the pressure of the pilot portion 11*d* overcomes the acting force of the adjustment spring 11*c*, and thus the first control valve 11 is switched to the supply position 11*a*. The first control valve 11 is a proportional valve that can steplessly adjust the opening degree of the supply passage 41 according to the magnitude of the pilot pressure guided to the pilot portion 11*d*.

The first pilot valve 12 is a solenoid valve that is switched based on the operation of an operation lever (not shown in the figure) by a user. The first pilot valve 12 has a supply position 12*a* where the working oil in a high-pressure passage 44 which is branched from the supply passage 41 and to which a discharge pressure of the pump 10 is guided is guided to the pilot portion 11*d* of the first control valve 11 and an interruption position 12*b* where the working oil in the high-pressure passage 44 is interrupted and where the working oil guided to the pilot portion 11*d* is guided to the tank 9.

In a state where the operation lever is not operated by the user, the first pilot valve 12 is switched to the interruption position 12*b* by the acting force of a spring 12*c* (the state shown in the figure). The first pilot valve 12 can steplessly adjust the magnitude of the pilot pressure guided to the pilot portion 11*d* according to the amount of operation of the operation lever by the user.

The check valve 13 is a load check valve that is interposed between the first control valve 11 and the piston side pressure chamber 7. When the first control valve 11 is in the interruption position 11*b*, since the upstream working oil is guided to the tank 9, the check valve 13 is brought into a closed state by the acting force of a spring 13*a*. On the other hand, when the first control valve 11 is in the supply position 11*a*, the check valve 13 is pushed and opened by the high-pressure working oil discharged from the pump 10 and is thereby brought into an opened state.

The unload valve 14 is interposed between the pump 10 and the first control valve 11. When the first control valve 11 is in the supply position 11*a*, the unload valve 14 is switched such that the pressure of the working oil between the first control valve 11 and the check valve 13 is guided as the pilot pressure and that the working oil from the pump 10 is guided to the cylinder 3.

When the first control valve 11 is in the interruption position 11*b*, the unload valve 14 is switched such that the working oil discharged from the pump 10 is unloaded to the tank 9. In the unload valve 14, the pressure of the working oil in the supply passage 41 located downstream of the first control valve 11 is guided to the one side as the pilot pressure, the pressure of the working oil in the supply passage 41 located upstream of the first control valve 11 is guided to the other side as the pilot pressure through an orifice 14*a*. The unload valve 14 is a pressure compensation valve in which, when a differential pressure between the pressure upstream of and the pressure downstream of the first control valve 11 exceeds a set pressure, the working oil from the pump 10 is unloaded to the tank 9.

The hydraulic control device 100 includes a shuttle valve 45 that selects which one of the pressure of the working oil supplied from the pump 10 and the pressure of the working oil in the piston side pressure chamber 7 of the cylinder 3 is higher and that switches to guide the pressure to a second pilot valve 22.

The working oil in the cylinder 3 is guided to one of the input ports of the shuttle valve 45 through a high-pressure passage 43 branched from the supply passage 41. The working oil is guided from the high-pressure passage 44 through a pilot passage 46 to the other of the input ports of the shuttle valve 45. The shuttle valve 45 is provided, and thus, even if the pump 10 is stopped to prevent the working oil from the high-pressure passage 44 from being supplied, it is possible to guide the working oil in the piston side pressure chamber 7 of the cylinder 3 guided through the supply passage 41 and the high-pressure passage 43 to the second pilot valve 22.

The hydraulic control device 100 includes a second control valve 21 that switches to discharge the working oil in the piston side pressure chamber 7 and thereby controls the contraction operation of the cylinder 3, a second pilot valve 22 that performs a pilot operation on the second control valve 21 with a pilot pressure, and an operate check valve 30 that interrupts the discharge of the working oil from the piston side pressure chamber 7 when it is switched to a closed state and that is interposed between the piston side pressure chamber 7 and the second control valve 21. The second control valve 21 and the operate check valve 30 are interposed in the discharge passage 42.

The second control valve 21 has a discharge position 21*a* through which the working oil from the piston side pressure chamber 7 can be passed and an interruption position 21*b* through which the working oil from the piston side pressure chamber 7 cannot be passed. The second control valve 21 includes an adjustment spring 21*c* that can adjust an acting force and a pilot portion 21*d* to which the pilot pressure from the second pilot valve 22 is guided.

In a state where the pilot pressure from the second pilot valve 22 is not guided to the pilot portion 21*d*, the second control valve 21 is switched to the interruption position 21*b* by the acting force of the adjustment spring 21*c* (the state shown in the figure).

When the pilot pressure from the second pilot valve 22 is guided to the pilot portion 21*d*, the pressure of the pilot portion 21*d* overcomes the acting force of the adjustment spring 21*c*, and thus the second pilot valve 22 is switched to the discharge position 21*a*. The second control valve 21 is a proportional valve that can steplessly adjust the opening degree of the discharge passage 42 according to the magnitude of the pilot pressure guided to the pilot portion 21*d*.

The second control valve 21 is a spool valve that is opened and closed by the movement of a spool (not shown in the figure). Hence, even when the second control valve 21 is switched to the interruption position 21*b*, the working oil in the discharge passage 42 may leak from the pilot portion 21*d*. Therefore, the operate check valve 30 is provided upstream of the second control valve 21, and thus the working oil in the discharge passage 42 is completely interrupted.

The second pilot valve 22 is a solenoid valve that is switched based on the operation of the operation lever (not shown in the figure) by the user. The second pilot valve 22 has a supply position 22*a* in which the working oil guided from the shuttle valve 45 is guided to the pilot portion 21*d* of the second control valve 21 and an interruption position 22*b* in which the working oil guided from the shuttle valve 45 is interrupted and in which the downstream working oil is guided to the tank 9.

In a state where the operation lever is not operated by the user, the second pilot valve 22 is switched to the interruption position 22*b* by the acting force of a spring 22*c* (the state shown in the figure). The second pilot valve 22 can steplessly adjust the magnitude of the pilot pressure guided to the pilot portion 21*d* according to the amount of operation of the operation lever.

The pilot pressure guided through the second pilot valve 22 is the higher pressure selected by the shuttle valve 45, of the pressure of the working oil supplied from the pump 10 and the pressure of the working oil in the piston side pressure chamber 7 of the cylinder 3.

The operate check valve 30 is a check valve that is opened by the pilot pressure from the second pilot valve 22 that performs the pilot operation on the second control valve 21. The operate check valve 30 is provided directly downstream of the piston side pressure chamber 7 of the cylinder 3. In this way, the operate check valve 30 can interrupt the discharge of the working oil from the piston side pressure chamber 7 when the operate check valve 30 is switched to the closed state.

The operate check valve 30 includes a valve member 31 that interrupts the discharge of the working oil from the piston side pressure chamber 7 when the operate check valve 30 is switched to the closed state, a spool 32 that is provided to face the back surface of the valve member 31, a back pressure chamber 33 that is defined between one end of the spool 32 and the back surface of the valve member 31, and a switch pressure chamber 34 which is defined to face the other end of the spool 32 and in which the pilot pressure is guided through the second pilot valve 22.

The pressure of the working oil in the discharge passage 42 acts on the front surface of the valve member 31. In the valve member 31, an orifice 31*a* is formed as an aperture that constantly guides the working oil in the discharge passage 42 to the back pressure chamber 33. Thus, on the back surface of the valve member 31, the pressure of the working oil guided from the discharge passage 42 though the orifice 31*a* acts.

The working fluid from the piston side pressure chamber 7 flows into the back pressure chamber 33 through the orifice 31*a*. In the back pressure chamber 33, a spring 33*a* that applies, to the valve member 31, a force acting in the direction in which the valve is closed is stored. The pressure of the back pressure chamber 33 and the acting force of the spring 33*a* described above act such that the valve member 31 is seated in a valve seat.

In a state where the valve member 31 is seated in the valve seat, the operate check valve 30 functions as a check valve that interrupts the flow of the working oil from the piston side pressure chamber 7 to the tank 9. In this way, the leak of the working oil in the piston side pressure chamber 7 is prevented, and the load pressure is retained. Thus, the stopped state of the piston rod 4 and the operation machine 2 is retained.

The spool 32 can be moved by the pilot pressure guided through the second pilot valve 22 to the switch pressure chamber 34. The spool 32 includes a poppet valve 32*a* that hermetically seals the back pressure chamber 33 in the state where the valve member 31 is seated in the valve seat. The spool 32 is moved in the direction in which the poppet valve 32*a* is closed by the pressure of the working oil in the back pressure chamber 33. The spool 32 is moved in the direction in which the poppet valve 32*a* is opened by a pressure in the switch pressure chamber 34.

The spool 32 is formed such that the pressure receiving area of a surface facing the switch pressure chamber 34 is larger than that of a surface facing the back pressure chamber 33. Hence, when the pressures of the working oil in the back pressure chamber 33 and the switch pressure chamber 34 are equal to each other, the spool 32 is moved in the direction in which the poppet valve 32*a* is opened by the difference of the pressure receiving areas.

The pilot pressure is guided through the second pilot valve 22 to the switch pressure chamber 34. When the pilot pressure guided to the switch pressure chamber 34 exceeds a set pressure, the spool 32 is moved to open the poppet valve 32*a*, and the working oil in the back pressure chamber 33 is discharged into the tank 9, with the result that the valve member 31 is switched to the opened state. The set pressure is set lower than a pressure at which the pilot operation on the second control valve 21 is started.

Thus, when the second pilot valve 22 is switched to the supply position 22*a*, the operate check valve 30 is first opened, then the second control valve 21 is switched to the discharge position 21*a* and the working oil in the piston side pressure chamber 7 is discharged into the tank 9.

The action of the hydraulic control device 100 will be described below.

A case where the hydraulic control device 100 extends the cylinder 3 to raise the operation machine 2 will first be described.

When the operation machine 2 is raised, the user operates the operation lever to switch the first pilot valve 12 to the supply position 12*a*. Thus, the pilot pressure is guided to the pilot portion 11*d* of the first control valve 11.

When the pilot pressure guided to the pilot portion 11*d* overcomes the acting force of the adjustment spring 11*c*, the first control valve 11 is switched to the supply position 11*a*. Here, the opening degree of the first pilot valve 12 and the opening degree of the first control valve 11 are steplessly adjusted based on the amount of operation of the operation lever by the user.

The working oil that has passed through the first control valve 11 overcomes the acting force of the spring 13*a* of the check valve 13, and is supplied through the supply passage 41 to the piston side pressure chamber 7 of the cylinder 3. Thus, the piston 5 is moved in the direction in which the piston rod 4 is moved out by the difference between the pressure receiving areas of the rod side pressure chamber 6 and the piston side pressure chamber 7. Hence, the cylinder 3 is extended, and the operation machine 2 is raised.

Here, the second pilot valve 22 is not operated by the user, and the operate check valve 30 is maintained in the closed state. Hence, the working oil supplied from the supply passage 41 is not discharged into the tank 9.

A case where the operation machine 2 is maintained at a given height by the hydraulic control device 100 will now be described.

When the operation machine 2 is maintained at a given height, the user does not operate the operation lever. Thus, the first control valve 11 is switched to the interruption position 11*b* by the acting force of the adjustment spring 11*c*, and the second control valve 21 is also switched to the interruption position 21*b* by the acting force of the adjustment spring 21*c* (the state shown in the figure).

Here, since the working oil from the pump 10 does not pass through the first control valve 11, the check valve 13 is in the closed state. Since the second pilot valve 22 is not operated by the user, the operate check valve 30 is also in the closed state. Thus, the working oil in the piston side pressure chamber 7 of the cylinder 3 is not discharged anywhere. Hence, the cylinder 3 is maintained to have a given length, and the operation machine 2 is maintained at a given height.

Since the working oil discharged from the pump 10 does not pass through the first control valve 11, the pressure of the working oil in the supply passage 41 between the pump 10 and the first control valve 11 is increased. Then, the pilot pressure guided through the orifice 14*a* causes the unload valve 14 to switch such that the working oil is unloaded. Thus, the pressure of the working oil in the supply passage 41 is prevented from being increased beyond necessity by the working oil discharged from the pump 10.

A case where the hydraulic control device 100 makes the cylinder 3 contract to lower the operation machine 2 will now be described.

When the operation machine 2 is lowered, the user operates the operation lever to switch the second pilot valve 22 to the supply position 22*a*. Thus, the pilot pressure is guided to the switch pressure chamber 34 of the operate check valve 30 and the pilot portion 21*d* of the second control valve 21.

When the pilot pressure guided to the switch pressure chamber 34 exceeds the set pressure, the operate check valve 30 moves the spool 32 to open the poppet valve 32*a*, discharges the working oil in the back pressure chamber 33 and switches the valve member 31 to the opened state. In this way, the working oil in the piston side pressure chamber 7 of the cylinder 3 passes through the operate check valve 30 and is guided to the second control valve 21.

When the pilot pressure guided to the pilot portion 21*d* overcomes the acting force of the adjustment spring 21*c*, the second control valve 21 is switched to the discharge position 21*a*. The second control valve 21 is switched to the discharge position 21*a* after the operate check valve 30 is brought into the opened state. Here, the opening degree of the second pilot valve 22 and the opening degree of the second control valve 21 are steplessly adjusted based on the amount of operation of the operation lever by the user.

As described above, when the operation machine 2 is lowered, the operate check valve 30 is first brought into the opened state to cancel the interruption of the discharge passage 42, and the operation machine 2 is brought into a state where the operation machine 2 can be lowered. Then, the opening degree of the discharge passage 42 is adjusted by the second control valve 21, and thus the operation machine 2 is lowered while the lowering speed is being adjusted.

As described above, the operate check valve 30 is opened by the pilot pressure of the second pilot valve 22 that performs the pilot operation on the second control valve 21. Thus, it is not necessary to additionally provide a solenoid valve for opening the operate check valve 30. Hence, it is possible to simplify the configuration of the hydraulic control device 100 controlling the tractor 1 and to reduce the cost of the hydraulic control device 100.

Here, as in the case where the operation machine 2 is maintained at a given height, the unload valve 14 is switched such that the working oil is unloaded. Thus, the pressure of the working oil in the supply passage 41 is prevented from being increased beyond necessity by the working oil discharged from the pump 10.

According to the embodiment described above, the following effects are produced.

Since the operate check valve 30 is opened by the pilot pressure of the second pilot valve 22 that performs the pilot operation on the second control valve 21, it is not necessary to additionally provide a solenoid valve for opening the operate check valve 30. Hence, it is possible to simplify the configuration of the hydraulic control device 100 controlling the tractor 1 and to reduce the cost of the hydraulic control device 100.

Embodiments of this invention were described above, but the above embodiments are merely examples of applications of this invention, and the technical scope of this invention is not limited to the specific constitutions of the above embodiments.

This application claims priority based on Japanese Patent Application No. 2012-021993 filed with the Japan Patent Office on Feb. 3, 2012, the entire contents of which are incorporated into this specification.

The embodiments of this invention in which an exclusive property or privilege is claimed are defined as follows:

The invention claimed is:

1. A fluid pressure control device which makes a cylinder expand and contract with a working fluid supplied from a pump to be able to drive a load and in which the cylinder includes a pressure chamber on which a load pressure by the load acts in a state where supply and discharge of the working fluid are interrupted, the fluid pressure control device comprising:

a first control valve that is configured to switch to supply the working fluid to the pressure chamber so as to control an extension operation of the cylinder;

a second control valve that is configured to switch to discharge the working fluid in the pressure chamber so as to control a contraction operation of the cylinder;

an operate check valve that is interposed between the pressure chamber and the second control valve and that interrupts the discharge of the working fluid from the pressure chamber when the operate check valve is switched to a closed state; and a pilot valve that is configured to perform, with a pilot pressure, a pilot operation on the second control valve and that is configured to switch, with the pilot pressure, the operate check valve to an opened state, wherein the operate check valve includes:

a valve member that interrupts the discharge of the working fluid from the pressure chamber when the valve member is switched to a closed state;

a spool that is provided to face a back surface of the valve member and that can be moved by the pilot pressure guided through the pilot valve;

a back pressure chamber which is defined between an end of the spool and the back surface of the valve member and to which the working fluid from the pressure chamber is guided through an aperture formed in the valve member; and a switch pressure chamber which is defined to face the other end of the spool and to which the pilot pressure is guided through the pilot valve, and when the pilot pressure guided to the switch pressure chamber exceeds a set pressure, the valve member is switched to an opened state by movement of the spool to discharge the working fluid in the back pressure chamber.

2. The fluid pressure control device according to claim 1, further comprising:

a check valve that is interposed between the first control valve and the pressure chamber and that is configured to allow only passage of the working fluid supplied from the pump to the pressure chamber.

3. The fluid pressure control device according to claim 1, wherein the set pressure is set lower than a pressure at which the pilot operation on the second control valve is operated.

4. The fluid pressure control device according to claim 1, wherein the spool and the back pressure chamber are provided on a same side facing the back surface of the valve member.

5. A fluid pressure control device which makes a cylinder expand and contract with a working fluid supplied from a pump to be able to drive a load, and in which the cylinder includes a pressure chamber on which a load pressure by the load acts in a state where supply and discharge of the working fluid are interrupted, the fluid pressure control device comprising:

a first control valve that is configured to switch to supply the working fluid to the pressure chamber so as to control an extension operation of the cylinder;

a second control valve that is configured to switch to discharge the working fluid in the pressure chamber so as to control a contraction operation of the cylinder;

an operate check valve that is interposed between the pressure chamber and the second control valve and that interrupts the discharge of the working fluid from the pressure chamber when the operate check valve is switched to a closed state;

a pilot valve that is configured to perform, with a pilot pressure, a pilot operation on the second control valve and that is configured to switch, with the pilot pressure, the operate check valve to an opened state; and a shuttle valve that is configured to select a higher one of a pressure of the working fluid supplied from the pump and a pressure of a working oil in the pressure chamber, as the pilot pressure guided through the pilot valve.

* * * * *